US007543807B2

(12) United States Patent
Tregoning

(10) Patent No.: US 7,543,807 B2
(45) Date of Patent: Jun. 9, 2009

(54) IMAGING SYSTEM AND METHOD

(75) Inventor: Michael A. Tregoning, Greeley, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 584 days.

(21) Appl. No.: 11/210,410

(22) Filed: Aug. 24, 2005

(65) Prior Publication Data

US 2007/0045931 A1 Mar. 1, 2007

(51) Int. Cl.
*B65H 5/26* (2006.01)

(52) U.S. Cl. ..... 271/9.09; 271/3.01; 271/3.14; 358/474

(58) Field of Classification Search ..... 271/3.01, 271/3.14, 34, 9.09; 358/474; 399/377
See application file for complete search history.

(56) References Cited

U.S. PATENT DOCUMENTS

| | | | | |
|---|---|---|---|---|
| 2,601,196 | A * | 6/1952 | Willis | 355/29 |
| 2,672,787 | A * | 3/1954 | Schreiber et al. | 355/72 |
| 6,163,385 | A | 12/2000 | Kajander | |
| 6,185,011 | B1 | 2/2001 | William | |
| 6,417,937 | B1 | 7/2002 | Batten et al. | |
| 6,519,023 | B1 | 2/2003 | Chang | |
| 6,614,563 | B1 | 9/2003 | Batten et al. | |
| 6,850,344 | B2 | 2/2005 | Chang | |
| 2003/0020970 | A1 | 1/2003 | Haas et al. | |
| 2003/0052956 | A1 * | 3/2003 | Katsuyama | 347/108 |

* cited by examiner

*Primary Examiner*—Patrick H Mackey
*Assistant Examiner*—Thomas A Morrison

(57) ABSTRACT

An imaging system comprises an imaging device having a manual feed mechanism integrated into a lid thereof. The manual feed mechanism is actuatable to feed a media object to a platen of the imaging device for imaging thereof.

35 Claims, 2 Drawing Sheets

IMAGING SYSTEM AND METHOD

BACKGROUND OF THE INVENTION

Imaging systems, such as flatbed scanners and other types of imaging and/or scanning devices, are used to scan or otherwise generate an image of a media object (e.g., photographs). However, using the imaging system for such media objects is generally a time-consuming and tedious. For example, closing a scanner lid over the media object may cause the media object to become skewed. However, the user generally is unaware of the skewed condition of the media object until after the scanning operation is complete, thereby requiring the user to re-position the media object and repeat the scanning operation, which repetition becomes increasingly time-consuming for multiple media objects (e.g., a stack of photographs).

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE DRAWINGS

Figure 1:
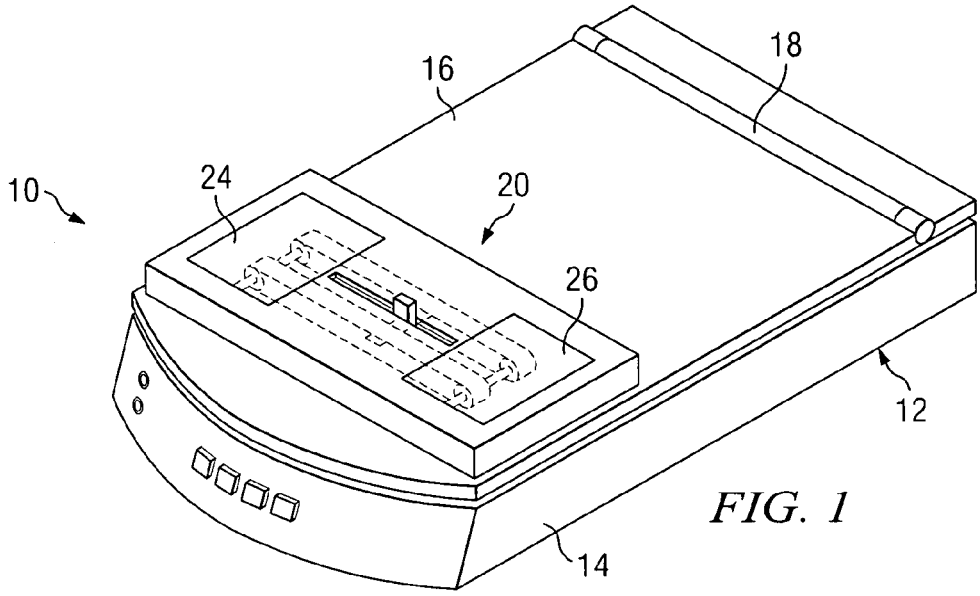
FIG. 1 is a diagram illustrating an embodiment of an imaging system in accordance with the present invention.
Figure 2:
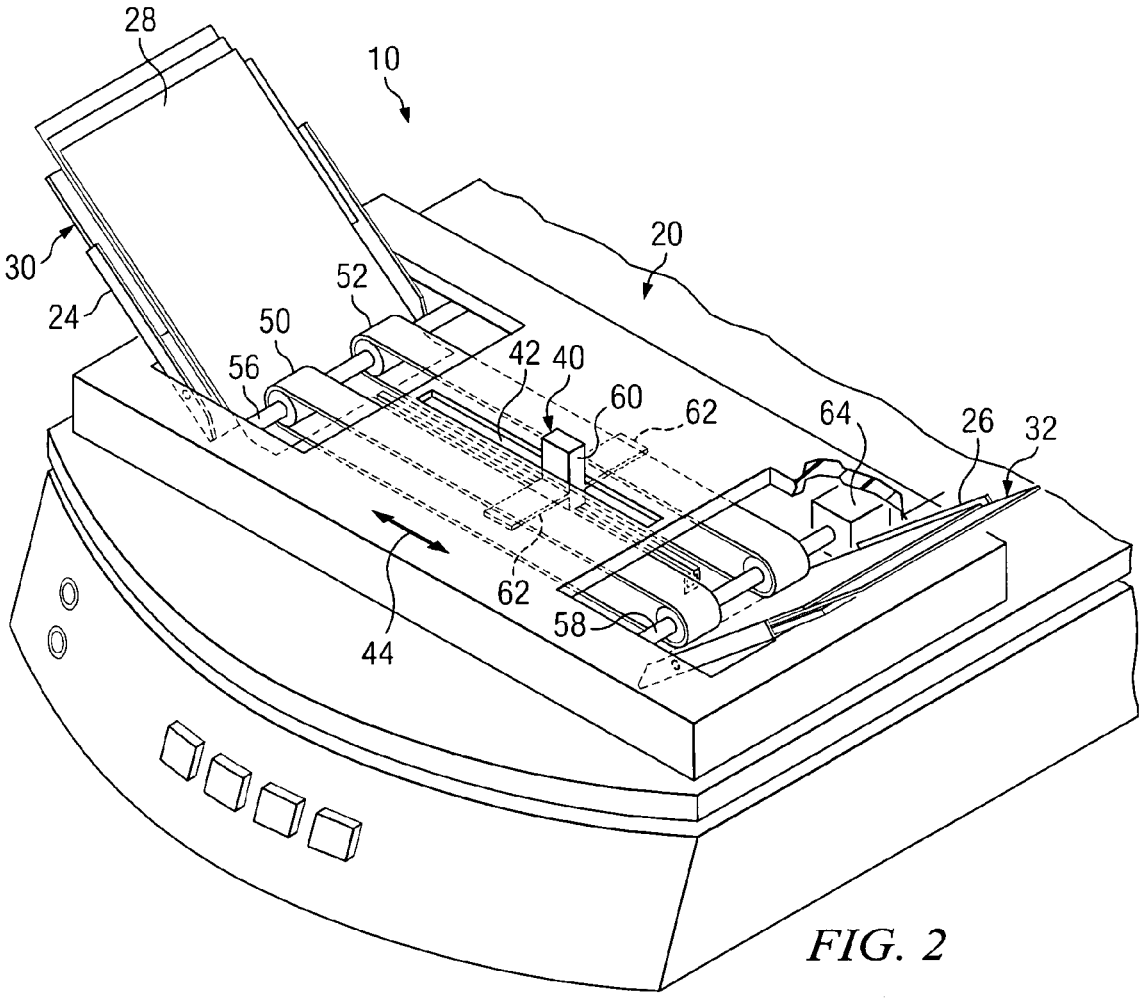
FIG. 2 is a diagram illustrating another view of the imaging system of FIG. 1.
Figure 3:
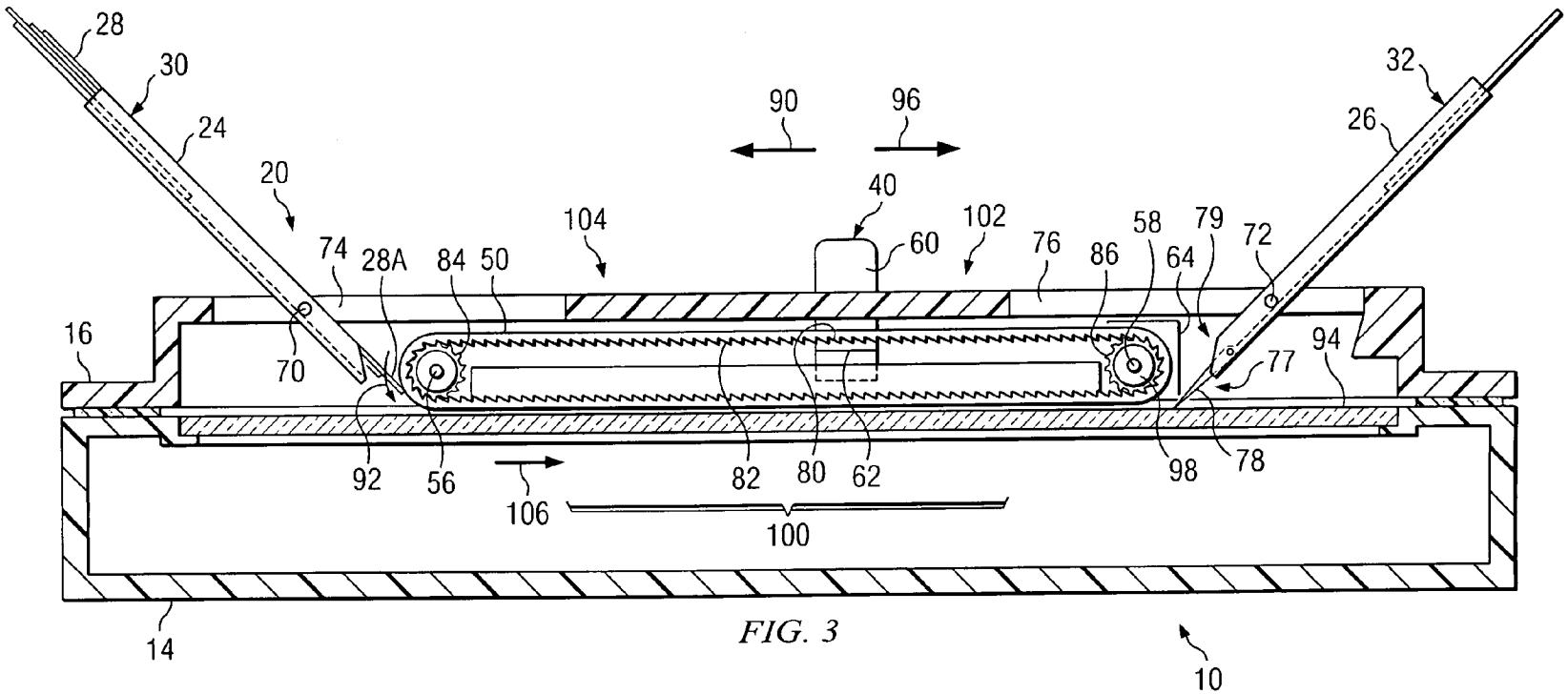
FIG. 3 is a diagram illustrating a sectional view of the imaging system of FIGS. 1 and 2.

The preferred embodiments of the present invention and the advantages thereof are best understood by referring to FIGS. 1-3 of the drawings, like numerals being used for like and corresponding parts of the various drawings.

FIG. 1 is a diagram illustrating an embodiment of an imaging system 10 in accordance with the present invention. In the embodiment illustrated in FIG. 1, imaging system 10 comprises an imaging device 12 having a base unit 14 and a lid 16 adapted to be disposed over base unit 14. Imaging device 12 comprises any type of device for generating an image of a media object such as, but not limited to, a scanner, copier or facsimile device. In the embodiment illustrated in FIG. 1, lid 16 is rotatably coupled to base unit 14 via a hinge assembly 18 to enable opening and closing of lid 16 relative to base unit 14 (illustrated in a closed position in FIG. 1) to facilitate placement of media objects onto a platen of base unit 14 (shown in FIG. 3 as platen 94) for generating an image of such media objects.

In the embodiment illustrated in FIG. 1, imaging system 10 comprises a manual feed mechanism 20 actuatable by a user to enable the user to manually feed media objects onto a platen of base unit 14 for imaging of such media objects and eject such media objects from the platen after imaging thereof. In the embodiment illustrated in FIG. 1, feed mechanism 20 is integrated into lid 16 (e.g., formed integrally with lid 16 or as a unitary structure). However, it should be understood that manual feed mechanism 20 may be otherwise configured.

FIG. 2 is a diagram illustrating an enlarged view of system 10 of FIG. 1. In the embodiment illustrated in FIG. 2, manual feed mechanism 20 comprises doors 24 and 26 formed in lid 16 and openable relative to lid 16 to facilitate feeding of media objects 28 onto a platen of base unit 14 (illustrated in FIG. 3 as platen 94). For example, in the embodiment illustrated in FIG. 2, doors 24 and 26 are rotatably coupled to lid 16 to facilitate opening and closing of doors 24 and 26 relative to lid 16 (doors 24 and 26 illustrated as closed relative to lid 16 in FIG. 1 and open relative to lid 16 in FIG. 2). However, it should be understood that doors 24 and 26 may be otherwise movably coupled to lid 16 (e.g., slidably and/or translatably openable relative to lid 16). Thus, in the embodiment illustrated in FIGS. 1 and 2, doors 24 and 26 are openable relative to lid 16 to facilitate feeding of media objects 28 through lid 16. However, it should be understood that feed mechanism 20 may be otherwise configured (e.g., to facilitate feeding of media objects 28 onto a platen of base unit 14 without feeding such media objects through lid 16 such as, but not limited to, feeding media objects 18 into an opening formed between lid 16 and base unit 14). In the embodiment illustrated in FIG. 2, feed mechanism 20 is configured such that opening of doors 24 and 26 form input/output trays for the media objects 28. For example, in the embodiment illustrated in FIG. 2, open door 24 is illustrated as an input tray 30 for a stack of media objects 28 disposed thereon, and open door 26 is configured as an output tray 32 for receiving media objects 28 from the platen of base unit 14 after imaging thereof.

In the embodiment illustrated in FIG. 2, feed mechanism 20 comprises a translatable or slidable feed lever 40 actuatable by a user to facilitate feeding of media objects 28 from input tray 30 to a platen of base unit 14 for scanning thereof, and ejecting media objects from the platen onto output tray 32. In the embodiment illustrated in FIG. 2, feed lever 40 extends at least partially through lid 16 via an opening 42 formed in lid 16 such that feed lever 40 is translatable by a user in the directions indicated generally by arrow 44 corresponding generally with a direction extending from input tray 30 to output tray 32. In the embodiment illustrated in FIG. 2, feed lever 40 is coupled to belts 50 and 52, and belts 50 and 52 are each coupled at opposing ends thereof to rotatable axles 56 and 58. In the embodiment illustrated in FIG. 2, feed lever 40 comprises a vertical portion 60 extending upwardly through opening 42 and a horizontal portion 62 extending outwardly from each side of vertical portion 60 to engage corresponding belts 50 and 52. In operation, movement of feed lever 40 in a particular direction causes movement of belts 50 and 52 to facilitate retrieval of media objects 28 from input tray 30 and feeding of media objects 28 toward a platen of base unit 14 for imaging thereof. Further, movement of feed lever 40 and, correspondingly, movement of belts 50 and 52, facilitate removal of media objects from the platen and ejection thereof onto output tray 32.

In the embodiment illustrated in FIG. 2, imaging system 10 comprises an actuator 64 to facilitate automatic feeding of media objects 28 from input tray 30 to the platen of base unit 14 for scanning thereof, and ejecting media objects from the platen onto output tray 32. For example, in the embodiment illustrated in FIG. 2, actuator 64 is coupled to axle 58 to facilitate automatic rotation of axle 58 and, correspondingly, movement of belts 50 and 52. Actuator 64 may comprise any type of drive mechanism for imparting rotational movement to axle 58. It should also be understood that actuator 64 may be coupled to other elements of imaging system 10 to facilitate automatic feeding of media objects 28. In the embodiment illustrated in FIG. 2, system 10 is illustrated as being manufactured having both actuator 64 and manual feed mechanism 20 to facilitate either automatic or manual feeding of media objects 28 for imaging thereof. However, it should be understood that system 10 may be otherwise configured (e.g., for automatic feeding only of media objects, that all or portions of manual feed mechanism 20 may be omitted (e.g., feed lever 40), and for manual feeding only of media objects, all or portions of automatic mechanisms may be omitted (e.g., actuator 64)).

FIG. 3 is a diagram illustrating a sectional view of imaging system 10 of FIG. 1 and 2. In the embodiment illustrated in FIG. 3, doors 24 and 26 are rotatably coupled to lid 16 via pins 70 and 72, respectively, to facilitate opening and closing of doors 24 and 26 relative to lid 16. For example, in the embodiment illustrated in FIG. 3, doors 24 and 26 are illustrated in an open position, thereby forming openings 74 and 76, respectively, in lid 16 to facilitate feeding and ejection of media objects 28 therethrough. However, it should be understood that doors 24 and 26 may be otherwise coupled to lid 16. In the embodiment illustrated in FIG. 3, door 26 comprises a recovery mechanism 77 to facilitate recovery, direction and ejection of media objects 28 from a platen 94 of imaging device 12. In the embodiment illustrated in FIG. 3, recovery mechanism 77 comprises a recovery strip 78 rotatably coupled to an end 79 of door 26 disposed near platen 94 when door 26 is disposed in the open position. For example, rotatably coupling recovery strip 78 to door 26 facilitates opening and closing of door 26 relative to lid 16 while enabling movement of recovery strip 78 relative to door 26 so as to avoid interference of recovery strip 78 with platen 94 during such opening/closing movement of door 26 and enable placement of recovery strip 78 at a position relative to platen 94 to "scoop" or recover media objects from platen 94. However, it should be understood that other devices or methods may be used to facilitate recovery of media objects 28 from platen 94. Further, in some embodiments of the present invention, imaging system 10 may be manufactured having guide elements or directional rails to prevent misalignment of media objects 28 as media objects 20 are fed across platen 94.

In the embodiment illustrated in FIG. 3, only belt 50 is illustrated; however, it should be understood that belt 52 is similarly configured. Further, in the embodiment illustrated in FIGS. 1-3, two belts (belts 50 and 52) are used in feed mechanism 20. However, it should be understood that a greater or fewer quantity of belts may be used as well as another means or mechanism besides belts for feeding/ejecting media objects 28. As best illustrated in FIG. 3, horizontal portion 62 of feed lever 40 comprises directionally-oriented teeth 80 for engaging corresponding directionally-oriented teeth 82 of belts 50 and 52 to facilitate engagement of feed lever 40 with belts 50 and 52 when feed lever 40 is moved in a particular direction relative to lid 16. Axles 56 and 58 are also configured having directionally-oriented teeth 84 and 86, respectively, for engaging belts 50 and 52.

In operation, in the embodiment illustrated in FIG. 3, in response to movement of feed lever 40 in the direction indicated generally by arrow 90, teeth 80 of feed lever 40 engage corresponding teeth 82 of belts 50 and 52, thereby causing movement of belts 50 and 52 in the direction indicated generally by 92. Movement of belts 50 and 52 in the direction indicated by 92 causes belts 50 and 52 to engage a media object 28A disposed on input tray 30 (e.g., since media object 28A is located closest to belts 50 and 52 with remaining media objects 28, if any, disposed behind media object 28A), thereby moving and/or feeding media object 28A from input tray 30 onto platen 94 of base unit 14 for imaging thereof. In the embodiment illustrated in FIG. 3, because teeth 80 and 82 are directionally-oriented, feed lever 40 is configured to engage belts 50 and 52 when feed lever 40 is moved in the direction indicated by arrow 90 and not engage belts 50 and 52 when feed lever 40 is moved in the direction indicated by arrow 96. For example, when feed lever 40 is moved in the direction indicated by arrow 96, portion 62 of feed lever 40 generally slides over teeth 82 of belts 50 and 52, thereby enabling translational movement of feed lever 40 in the direction indicated by 96 without causing reverse movement of belts 50 and 52 (e.g., without causing movement of belts 50 and 52 in a direction opposite that of arrow 92). Further, in some embodiments of the present invention, feed mechanism 20 is configured having a clutch mechanism 98 to prevent movement of belts 50 and 52 in a direction opposite that indicated by arrow 92. In the embodiment illustrated in FIG. 3, axle 58 is configured having clutch mechanism 98 to prevent rotation of axle 58 in a direction opposite that indicated by arrow 92. However, it should be understood that alternatively, or additionally, axle 56 may be configured having clutch mechanism 98.

Preferably, in some embodiments of the present invention, system 10 is configured to move and/or feed media objects 28 to a predetermined location 100 of platen 94 such that the predetermined location 100 is registered and/or otherwise preset as a scanning location by imaging hardware and/or software of imaging device 12. For example, in some embodiments of the present invention, in response to movement of feed lever 40 in the direction indicated by 90 from a position indicated by arrow 102 to a position indicated by 104, belts 50 and 52 engage media objects 28 and move and/or otherwise feed media objects 28 along platen 94 in a feed direction 106 to predetermined location 100. During or after scanning of a particular media object 28 positioned at location 100, feed lever 40 is moved in the direction indicated by 96 from position 104 to position 102 in preparation for ejection of the media object 28 positioned at location 100 to output tray and, if additional media objects 28 are disposed in input tray 30, feeding another media object 28 to location 100 in response to repeat movement of feed lever 40 from position 102 to position 104.

Thus, embodiments of the present invention enable a user to manually or automatically feed media objects to a predetermined location 100 of platen 94 for imaging thereof, thereby substantially avoiding or eliminating a skew condition of such media objects. For example, embodiments of manual feed mechanism 20 enable a user to manually feed a media object 28 to a predetermined location 100 of platen 94 using feed lever 40, thereby resulting in proper placement and orientation of such media object for imaging thereof. Further, embodiments of the present invention enable convenient use and storage of feed mechanism 20. For example, embodiments of feed mechanism 20 enable convenient access and storage thereof by incorporating openable and closeable doors 24 and 26 for feeding media objects therethrough. Moreover, in some embodiments of the present invention, doors 24 and 26, when opened, serve as input and output trays for the media objects.

What is claimed is:

1. An imaging system, comprising:

an imaging device having a manual feed mechanism integrated into a lid thereof, the manual feed mechanism including at least one belt, the at least one belt configured to engage a media object and actuatable to feed the media object to a platen of the imaging device for imaging thereof, wherein the manual feed mechanism comprises a feed lever actuatable by a user, the feed lever including directionally-oriented teeth configured to engage mating teeth on the at least one belt only when the feed lever is moved in one direction.

2. The system of claim 1, wherein the manual feed mechanism is adapted to feed the media object from an input tray.

3. The system of claim 1, further comprising a door disposed in the lid openable relative to the lid to form an input tray for the media object.

4. The system of claim 1, further comprising a door disposed in the lid openable relative to the lid to form an output tray for the media object.

5. The system of claim 1, wherein the manual feed mechanism is adapted to feed the media object from an input tray to an output tray.

6. The system of claim 1, wherein the comprises a translatable feed lever for feeding the media object to the platen.

7. The system of claim 1, wherein the manual feed mechanism comprises a clutch mechanism for maintaining a predetermined feed direction for the media object.

8. The system of claim 1, wherein the feed lever comprises a translatable feed lever extending at least partially through the lid.

9. The system of claim 1, wherein the manual feed mechanism is adapted to feed the media object through the lid to the platen.

10. The system of claim 1, wherein the manual feed mechanism is adapted to position the media object in a predetermined location on the platen for imaging thereof.

11. A method for manufacturing an imaging system, comprising:

integrating a manual feed mechanism into a lid of an imaging device, the manual feed mechanism including at least one belt, the at least one belt configured to engage a media object and actuatable to feed the media object to a platen of the imaging device for imaging thereof; and incorporating a clutch mechanism into the manual feed mechanism, the clutch mechanism including directionally-oriented teeth configured to engage mating teeth on the at least one belt only when a feed lever is moved in one direction for maintaining a predetermined feed direction for the media object.

12. The method of claim 11, further comprising providing the lid having a door openable to form an input tray for the media object.

13. The method of claim 11, further comprising providing the lid having a door openable to form an output tray for the media object.

14. The method of claim 11, further comprising incorporating the feed lever as a translatable feed lever for moving the media object.

15. The method of claim 11, further comprising incorporating the feed lever as a translatable feed lever extending at least partially through the lid into the manual feed mechanism.

16. The method of claim 11, further comprising configuring the manual feed mechanism to feed the media object through the lid to the platen.

17. The method of claim 11, further comprising configuring the manual feed mechanism to feed the media object to a predetermined location of the platen.

18. An imaging system, comprising: means for manually feeding a media object to a platen of an imaging device for imaging thereof, the manually feeding means integrated into a lid of the imaging device, the manually feeding means including at least one belt configured to engage the media object, the manual feeding means including a feed lever actuatable by a user, the feed lever including directionally-oriented teeth configured to engage mating teeth on the at least one belt only when the feed lever is moved in one direction.

19. The system of claim 18, further comprising means disposed in the lid and openable relative to the lid to form an input tray for the media object.

20. The system of claim 18, wherein the feed lever comprises a translatable feed lever extending at least partially through the lid.

21. The system of claim 18, wherein the feed lever comprises a translatable feed lever for feeding the media object to the platen.

22. An imaging system, comprising: an imaging device having a feed mechanism integrated into a lid thereof, the feed mechanism including at least one belt configured to engage a media object, wherein the feed mechanism including a feed lever actuatable by a user, the feed lever including directionally-oriented teeth configured to engage mating teeth on the at least one belt only when the feed lever is moved in one direction, and at least one door openable relative to the lid to enable feeding of the media object by the feed mechanism therethrough to a platen of the imaging device.

23. The imaging system of claim 22, wherein the at least one door, when opened, forms an input tray for the media object.

24. The imaging system of claim 22, wherein the feed lever comprises a translatable feed lever for feeding the media object to the platen.

25. The imaging system of claim 22, wherein the feed mechanism is adapted to eject the media object from the platen.

26. The imaging system of claim 22, further comprising another door openable relative to the lid to enable ejection of the media object therethrough.

27. The imaging system of claim 22, wherein the feed lever extends at least partially through the lid.

28. The imaging system of claim 22, wherein the feed lever is adapted to move in at least two different directions.

29. The imaging system of claim 28, wherein the feed mechanism is configured with the directionally-oriented teeth to maintain a predetermined feed direction for the media object in one direction even in response to movement of the feed lever in the at least two different directions.

30. The imaging system of claim 22, wherein the feed mechanism is adapted to feed the media object to a predetermined location on the platen.

31. An imaging system, comprising:

a lid having a plurality of doors openable relative to the lid to facilitate feeding of a media object to a platen through an opening formed by at least one of the plurality of doors and retrieving the media object from the platen through an opening formed by at least another of the plurality of doors, wherein the feeding of the media object is by at least one belt; and a manual feed mechanism including a feed lever actuatable by a user, the feed lever including directionally-oriented teeth configured to engage mating teeth on the at least one belt only when the feed lever is moved in one direction.

32. The system of claim 31, wherein at least one of the plurality of doors forms an input tray for the media object.

33. The system of claim 31, wherein at least one of the plurality of doors forms an output tray for the media object.

34. The system of claim 31, further comprising a motorized actuator for automatically feeding the media object from the at least one of the plurality of doors to the at least another of the plurality of doors.

35. The system of claim 31, wherein the plurality of doors are rotatably coupled to the lid.

* * * * *

UNITED STATES PATENT AND TRADEMARK OFFICE

CERTIFICATE OF CORRECTION

PATENT NO. : 7,543,807 B2
APPLICATION NO. : 11/210410
DATED : June 9, 2009
INVENTOR(S) : Michael A. Tregoning It is certified that error appears in the above-identified patent and that said Letters Patent is hereby corrected as shown below:

In column 5, line 10, in Claim 6, after "wherein the" insert -- feed lever --.

Signed and Sealed this

Sixth Day of April, 2010

David J. Kappos

David J. Kappos
*Director of the United States Patent and Trademark Office*